US006293758B1

(12) United States Patent
Green et al.

(10) Patent No.: US 6,293,758 B1
(45) Date of Patent: Sep. 25, 2001

(54) PERISTALTIC PUMP PROVIDED WITH A PRESSURE MEASUREMENT DEVICE TO MONITOR THE CONDITION OF THE HOSE

(75) Inventors: Andrew John Green, Falmouth Cornwall (GB); Hanjo Kruisinga, Enschede (NL)

(73) Assignee: Bredel Hose Pumps B.V. (NL)

( * ) Notice: Subject to any disclaimer, the term of this patent is extended or adjusted under 35 U.S.C. 154(b) by 0 days.

(21) Appl. No.: 09/354,057

(22) Filed: Jul. 15, 1999

(30) Foreign Application Priority Data

Jul. 15, 1998 (GB) ..... 9815394

(51) Int. Cl.[7] ..... F04B 19/24
(52) U.S. Cl. ..... 417/53
(58) Field of Search ..... 417/477.1, 477.12, 417/53, 63

(56) References Cited

U.S. PATENT DOCUMENTS 4,617,014 10/1986 Cannon et al. .
4,702,675 * 10/1987 Aldrovandi et al. ..... 417/63
4,882,575 11/1989 Kawahara .
5,720,721 2/1998 Dumas et al. .

* cited by examiner

*Primary Examiner*—Charles G. Freay
*Assistant Examiner*—W Rodriguez
(74) *Attorney, Agent, or Firm*—David C. Jenkins; Arnold B. Silverman; Eckert Seamans Cherin & Mellott, LLC

(57) ABSTRACT

A peristaltic pump has a sealed pumphead housing a and a pressure transducer 26 which is responsive to the pressure within the pumphead housing 8. The output 28 of the transducer 26 is processed to provide an indication of the condition of the hose 18 of the pump.

15 Claims, 1 Drawing Sheet

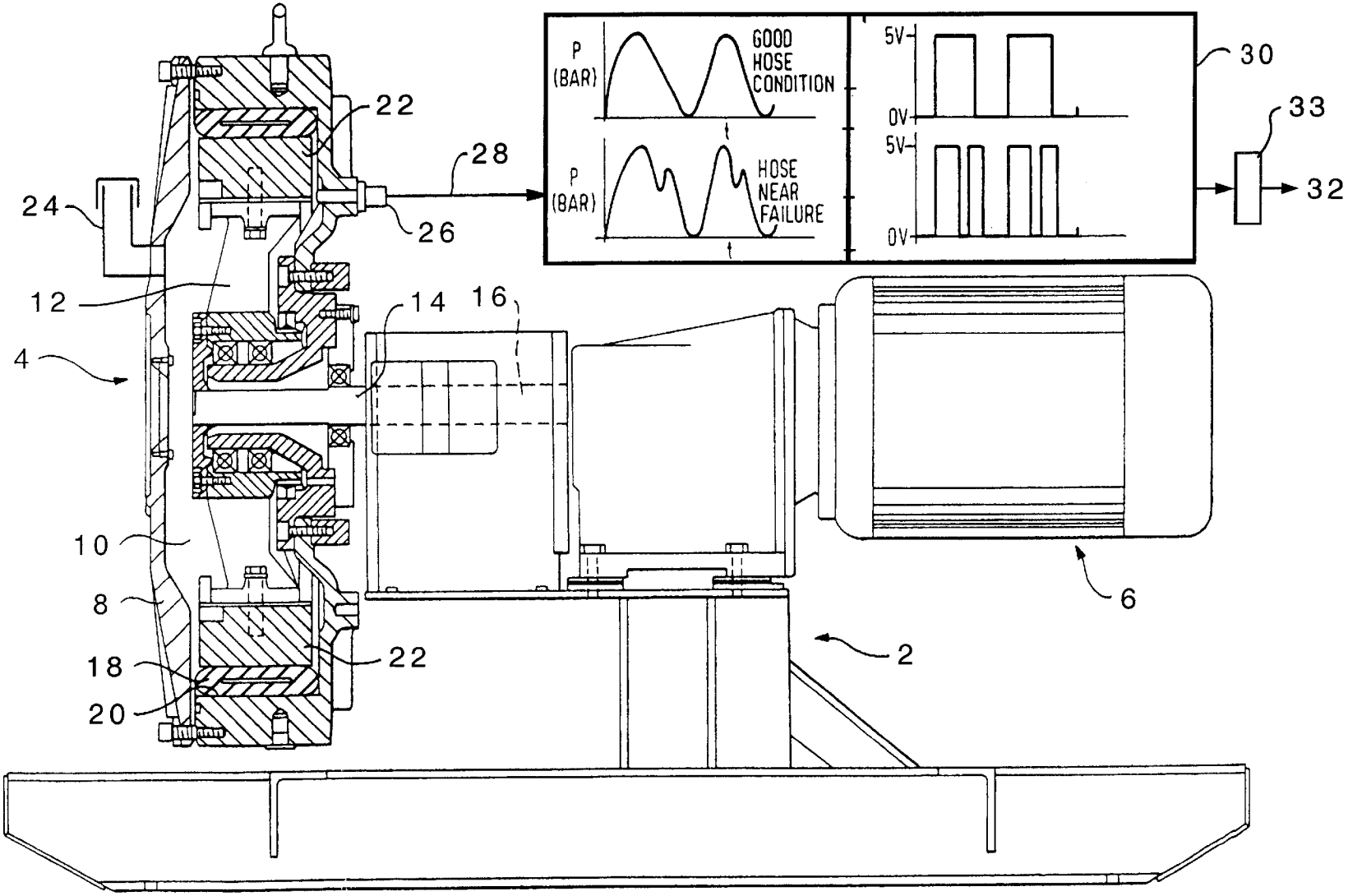
30
33
32
5V
0V
5V
0V
GOOD HOSE CONDITION
HOSE NEAR FAILURE
P (BAR)
P (BAR)
t
t
6
2
28
26
22
16
14
22
24
12
4
10
8
18
20

PERISTALTIC PUMP PROVIDED WITH A PRESSURE MEASUREMENT DEVICE TO MONITOR THE CONDITION OF THE HOSE

FIELD OF THE INVENTION

This invention relates to peristaltic pumps, and to the prediction of hose failure in such pumps.

BACKGROWMD OF THE INVETION

The failure of a hose in a peristaltic pump results in contamination of the pumphead with the contents of the hose or vice versa, and consequently the pump has to be shut down for cleaning. It is therefore desirable to be able to predict incipient hose failure in a reliable manner so that the hose can be replaced before failure occurs.

SUMMARY OF THE PRESENT INVENTION

According to one aspect of the present invention there is provided a method of monitoring performance of a peristaltic pump comprising a pumphead housing in which a hose is subjected to a peristaltic action, the method comprising monitoring pressure fluctuations in a fluid within the pumbhead housing externally of the hose, Changes in the characteristics of the pressure fluctuations can provide an indicator of incipient hose failure, and consequently, in a preferred method, a characteristic of the waveform, such as the frequency of waveform peaks, is monitored. It has been found that the frequency of waveform peaks tends to increase when the hose is about to fail.

The monitoring of the pressure fluctuations may be achieved by means of a pressure transducer, and the analogue output of the transducer may be converted to a digital signal which is analyzed to provide an output representing hose condition.

Another aspect of the present invention provides a peristaltic pump comprising a pumphead housing in which a tube is subjected to a peristaltic action, means being provided for monitoring pressure fluctuations in a fluid within the housing externally of the hose.

The pumphead housing may be sealed from the ambient surroundings, in which case it may be provided with a pressure relief-valve to avoid excessive build up of pressure within the pumphead housing should the hose fail.

BRIEF DESCRIPTION OF THE DRAWINGS

The FIGURE is a partly sectioned side view of a peristaltic pump.

DETAILED DESCRIPTION OF A PREFERRED EMBODIMENT

The pump comprises a support frame 2 carrying a pumphead 4 and a motor 6. The pumphead 4 comprises a housing 8, the interior 10 of which is sealed from the ambient surroundings. A rotor 12 is supported for rotation within the housing 8 and is connected by an input shaft 14 to an output shaft 16 of the motor 6.

A hose 18 extends around a reaction surface 20 of the housing 8. The Opposite ends of the hose 18 (not shown) are connected respectively to an inlet and an outlet of the pump.

The rotor 12 has oppositely disposed lobes 22 which compress the hose 18 against the reaction surface 20 to close the tube 18 at those points. Rotation of the rotor 12 causes these compressed regions to travel along the tube 18, so providing a peristaltic action which displaces fluid through the pump.

The pumphead housing 8 has a pressure relief unit 24 to vent the interior of the housing 8 if excessive pressure builds up. The pumphead housing a also has a pressure transducer 26 which provides an analogue signal 28 representing the pressure within the interior of the housing 8. The signal 28 is supplied to an analogue-to-digital converter 30 to provide a digital output signal 32.

In operation the rotor 12 is driven within the stationary housing 8 by the motor 6. The lobes 22 exert a peristaltic action on the tube 18, forcing fluid from the inlet to the outlet. This causes a variation in the overall tube volume within the housing 8, resulting in pressure fluctuations which are sensed by the transducer 26 to produce an analogue output signal. When the hose 18 is in a good condition, this output signal has a sinusoidal waveform as shown in the top left-hand region of the box representing the analogue-to-digital converter 30. The converter 30 converts this waveform to a digital 0 to 5V TTL form as shown in the top right-hand corner of the converter 30. This digital output, 32 is processed by further circuitry 33 which responds to the frequency of the digital waveform. In the embodiment shown in the Figure, there are two lobes 22, and this causes two pressure pulses in each revolution of the rotor 12, and consequently the frequency of the digital output is double the rotational speed of the rotor 12.

The hose 18 may, for example, comprise inner and outer polymer skins with a helically wound fibre reinforcement between them. After prolonged operation of the pump, cracks in the hose wall tend to form, frequently propagating from the inner polymer skin to the fibre reinforcement. Once the crack reaches the fibre reinforcement, the outer skin is effectively unreinforced and tends to balloon outwards when under pressure. This distorts the normal pattern of pressure fluctuation in the interior 10 of the housing 8 and so causes the superimposition of a cyclic signal on the normal sinusoidal waveform, resulting in a modified waveform shown, by way of example, in the lower left-hand corner of the converter 30. This is converted to the digital output shown in the lower right-hand corner of the converter 30 and, as will be appreciated, this signal has a frequency which is double that of the frequency of the signal produced when the hose is in good condition. Thus there are four pulses in each revolution of the rotor 12.

Although the pump will continue to deliver fluid at or close to the expected rate, and will appear normal on visual inspection, the increased frequency of the digital signal 32 can be processed to provide an alarm, or to shut down the pump, to enable the hose to be replaced without the additional inconvenience of dealing with a burst hose.

Because the interior 10 of the housing a is sealed from the ambient surroundings, the pressure relief unit 24 is provided to avoid any damage which might occur as a result of excessive pressure build up within the housing 8, for example should the hose 18 eventually fail.

It will be appreciated that the output 28 of the transducer 26 may be processed in a manner other than that shown in the Figure in order to monitor other characteristics which might be indicative of incipient hose failure. Also, variations in the characteristics of the output of the transducer 26 may provide an indication of performance of the pump other than the condition of the hose 18.

We claim:

1. A method of monitoring performance of a peristaltic pump comprising a pumphead in which a hose is subjected to a peristaltic action in a housing, the method comprising monitoring pressure fluctuations in a fluid within the housing externally of the hose.

2. A method as claimed in claim 1 wherein said step of monitoring pressure fluctuations further comprises the step of monitoring a characteristic of the pressure waveform.

3. A method as claimed in claim 2, in which the frequency of the waveform peaks is monitored.

4. A method as claimed in claim 1, in which an analogue signal representing the pressure waveform is converted to a digital output.

5. A method as claimed in claim 1, in which an alarm signal is generated if the monitored pressure fluctuations deviate from a predetermined pattern.

6. A method as claimed in claim 1, which method is employed for predicting failure of the hose.

7. A method of predicting hose failure in a peristaltic pump, comprising a pumphead in which a hose is subjected to a peristaltic action in a housing, the method comprising monitoring pressure fluctuations in a fluid within the housing externally of the hose, analyzing the pressure fluctuations and providing an output representative of the condition of the hose.

8. A peristaltic pump comprising:

a pumphead having a housing;

a hose disposed at least partially within the housing;

means for subjecting the hose to a peristaltic action in the housing; and means for monitoring pressure fluctuations within the housing externally of said hoses.

9. A peristaltic pump as claimed in claim 8 wherein said means for monitoring Pressure fluctuations within the housing further comprises:

a pressure transducer which is responsive to pressure fluctuations within the pumphead housing; and monitoring circuitry for analyzing the output signal of the pressure transducer.

10. A peristaltic pump as claimed in claim 9, in which the monitoring circuitry is responsive to changes in the waveform of the transducer output signal.

11. A peristaltic pump as claimed in claim 10, in which the monitoring circuitry is in electrical communication with said pressure transducer and is responsive to changes in the waveform peaks of the transducer output signal.

12. A peristaltic pump as claimed in claim 9, further comprising an analogue-to-digital converter for converting an analogue output of the transducer to a digital signal.

13. A peristaltic pump as claimed in claim 8, further comprising means for generating an alarm when pressure fluctuations within the housing deviate from a predetermined pattern.

14. A peristaltic pump as claimed in claim 8, further comprising pressure relief means for relieving excess pressure within the pumphead housing.

15. A peristaltic pump as claimed in claim 8, in which the interior of the pumphead housing is sealed from the ambient surroundings.

* * * * *

UNITED STATES PATENT AND TRADEMARK OFFICE

CERTIFICATE OF CORRECTION

PATENT NO. : 6,293,758 B1
DATED : July 15, 1999
INVENTOR(S) : Andrew John Green et al.

It is certified that error appears in the above-identified patent and that said Letters Patent is hereby corrected as shown below:

Title page,
ABSTRACT,
Line 1, "pumphead housing a" should read -- pumphead housing 8 --.

Column 1,
Second Title, "BACKGROWMD OF THE INVETION" should read -- BACKGROUND OF THE INVENTION --.

Column 1,
Lines 23-24, "pumbhead" should read -- pumphead --, "hose," should read -- hose. --.
Line 60, "Opposite" should read -- opposite --.

Column 2,
Line 3, "pumphead housing a" should read -- pumphead housing 8 --.
Line 18, remove the "," after "output".
Line 50, "housing a" should read -- housing 8 --.

Column 3,
Lines 4-5, Claim 3 should read, -- A method as claimed in claim 2 wherein said step of monitoring a characteristic of the pressure waveform further comprises the step of monitoring the frequency of the waveform peaks. --

Signed and Sealed this

Twentieth Day of August, 2002

*Attest:*

*Attesting Officer*

JAMES E. ROGAN
*Director of the United States Patent and Trademark Office*